US006000239A

United States Patent [19]

Bonaquist et al.

[11] Patent Number: 6,000,239

[45] Date of Patent: Dec. 14, 1999

[54] CRYOGENIC AIR SEPARATION SYSTEM WITH HIGH RATIO TURBOEXPANSION

[75] Inventors: Dante Patrick Bonaquist, Grand Island; Nancy Jean Lynch, North Tonawanda, both of N.Y.

[73] Assignee: Praxair Technology, Inc., Danbury, Conn.

[21] Appl. No.: 09/113,175

[22] Filed: Jul. 10, 1998

[51] Int. Cl.[6] ..... F25J 3/00

[52] U.S. Cl. ..... 62/646; 62/939

[58] Field of Search ..... 62/646, 939

[56] References Cited

U.S. PATENT DOCUMENTS

| | | | |
|---|---|---|---|
| 4,303,428 | 12/1981 | Vandenbussche | 62/13 |
| 4,375,367 | 3/1983 | Prentice | 62/13 |
| 4,407,135 | 10/1983 | Pahade | 62/13 |
| 5,237,822 | 8/1993 | Rathbone | 62/25 |
| 5,263,328 | 11/1993 | Rohde | 62/939 |
| 5,287,704 | 2/1994 | Rathbone | 62/25 |
| 5,404,725 | 4/1995 | Arriulou | 62/646 |
| 5,437,161 | 8/1995 | Chretien | 62/939 |
| 5,454,226 | 10/1995 | Darredeau | 62/646 |
| 5,511,381 | 4/1996 | Higginbotham | 62/646 |
| 5,675,977 | 10/1997 | Prosser | 62/646 |

*Primary Examiner*—Ronald Capossela
*Attorney, Agent, or Firm*—Stanley Ktorides

[57] ABSTRACT

A cryogenic air separation system wherein a portion of the feed air is compressed to a very high pressure, bypasses the primary heat exchanger, and is turboexpanded to a low pressure to supply refrigeration in one step from the warm end temperature to the cryogenic temperature of the cryogenic air separation plant.

8 Claims, 1 Drawing Sheet

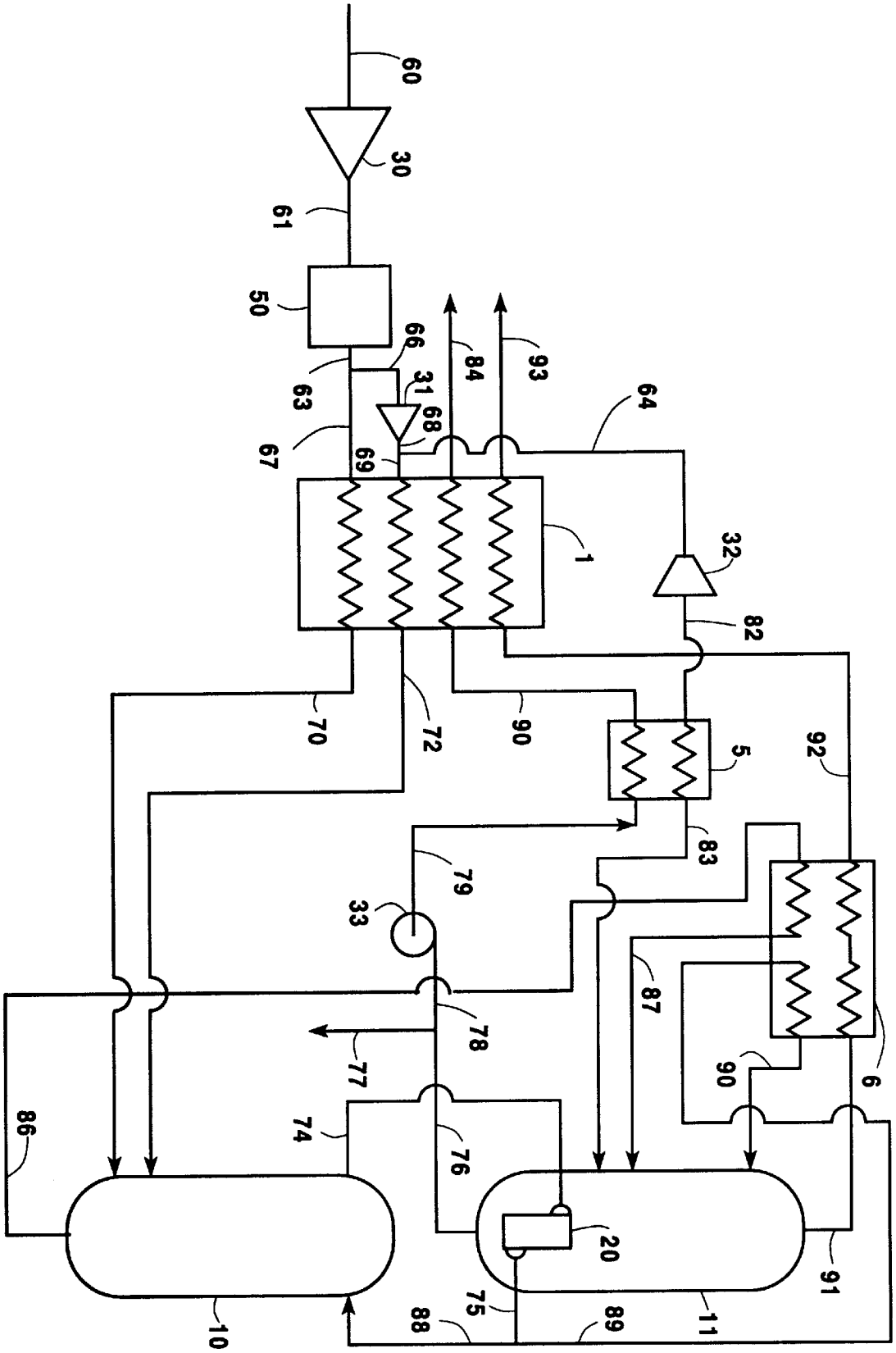
60
30
61
50
63
66
31
68
67
69
84
93
64
1
32
82
70
72
90
5
92
83
79
33
87
78
77
6
90
86
74
76
20
91
10
75
88
89
11

CRYOGENIC AIR SEPARATION SYSTEM WITH HIGH RATIO TURBOEXPANSION

TECHNICAL FIELD

This invention relates generally to the cryogenic rectification of feed air to produce at least one of product oxygen and product nitrogen.

BACKGROUND ART

The cryogenic rectification of feed air to produce at least one of product oxygen and product nitrogen is a well established industrial process. The feed air is separated in a cryogenic air separation plant, such as a double column plant having a higher pressure column and a lower pressure column. Refrigeration for the system is generally provided by the turboexpansion of a process stream such as a cooled feed air stream. Turboexpansion is an energy intensive operation and therefore any improvement to the energy efficiency of the refrigeration generation operation of a cryogenic air separation system would be very desirable.

Accordingly, it is an object of this invention to provide a cryogenic air separation system which can generate refrigeration by feed air turboexpansion with lower unit power requirements than comparable conventional systems.

SUMMARY OF THE INVENTION

The above and other objects, which will become apparent to one skilled in the art upon a reading of this disclosure are attained by the present invention, one aspect of which is:

A method for carrying out cryogenic air separation comprising:

(A) passing a first portion of the feed air for a cryogenic air separation plant through a primary heat exchanger and thereafter passing the first feed air portion into the cryogenic air separation plant;

(B) compressing a second portion of the feed air for the cryogenic air separation plant to a high pressure and passing at least some of the high pressure second feed air portion as input to a high ratio turboexpander without passing through any portion of the primary heat exchanger;

(C) turboexpanding the high ratio turboexpander input through the high ratio turboexpander and passing the resulting turboexpanded output into the cryogenic air separation plant;

(D) separating the feed air within the cryogenic air separation plant by cryogenic rectification to produce at least one of product oxygen and product nitrogen; and (E) recovering at least one of product oxygen and product nitrogen from the cryogenic air separation plant.

Another aspect of this invention is:

Apparatus for carrying out cryogenic air separation comprising:

(A) a primary heat exchanger and a cryogenic air separation plant;

(B) means for passing feed air to the primary heat exchanger and from the primary heat exchanger to the cryogenic air separation plant;

(C) a booster compressor, a high ratio turboexpander, means for passing feed air to the booster compressor, and means for passing feed air from the booster compressor to the high ratio turboexpander without passing through the primary heat exchanger;

(D) means for passing feed air from the high ratio turboexpander to the cryogenic air separation plant; and (E) means for recovering product from the cryogenic air separation plant.

As used herein, the term "feed air" means a mixture comprising primarily oxygen and nitrogen, such as ambient air.

As used herein, the term "column" means a distillation or fractionation column or zone, i.e. a contacting column or zone, wherein liquid and vapor phases are countercurrently contacted to effect separation of a fluid mixture, as for example, by contacting of the vapor and liquid phases on a series of vertically spaced trays or plates mounted within the column and/or on packing elements such as structured or random packing. For a further discussion of distillation columns, see the Chemical Engineer's Handbook fifth edition, edited by R. H. Perry and C. H. Chilton, McGraw-Hill Book Company, New York, Section 13, *The Continuous Distillation Process.*

The term "double column", is used to mean a higher pressure column having its upper end in heat exchange relation with the lower end of a lower pressure column. A further discussion of double columns appears in Ruheman "The Separation of Gases", Oxford University Press, 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is generally adiabatic and can include integral (stagewise) or differential (continuous) contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K).

As used herein, the terms "upper portion" and "lower portion" mean those sections of a column respectively above and below the mid point of the column.

As used herein, the term "indirect heat exchange" means the bringing of two fluids into heat exchange relation without any physical contact or intermixing of the fluids with each other.

As used herein, the term "primary heat exchanger" means the main heat exchanger associated with a cryogenic air separation process wherein feed air is cooled from ambient temperature to cold temperatures associated with the distillation by indirect heat exchange with return streams. The primary heat exchanger can also include subcooling column liquid streams and/or vaporizing product liquid streams.

As used herein, the term "cryogenic air separation plant" means the column(s) wherein feed air is separated by cryogenic rectification, as well as interconnecting piping, valves, heat exchangers and the like.

As used herein, the term "desuperheater" means a heat exchanger wherein a gaseous stream is cooled by indirect heat exchange with another colder process stream and wherein the cooled gaseous stream remains in the gas phase. Typically the gaseous stream will be fed to a distillation column and will be cooled versus a return product stream.

As used herein the terms "turboexpansion" and "turboexpander" mean respectively method and apparatus for the flow of high pressure gas through a turbine to reduce the pressure and the temperature of the gas thereby generating refrigeration.

As used herein the term "high ratio turboexpander" means a turboexpander wherein the pressure of the gas input to the turboexpander is at least 15 times the pressure of the gas output from the turboexpander. Although the high ratio turboexpander could be a single stage radial inflow unit, typically the high ratio turboexpander will have two or more stages with a serial flow arrangement.

BRIEF DESCRIPTION OF THE DRAWINGS

The sole FIGURE is a simplified schematic representation of one preferred embodiment of the invention wherein the cryogenic air separation plant comprises a double column.

DETAILED DESCRIPTION

The invention comprises the turboexpansion of a portion of the feed air from the warm end temperature upstream of the primary heat exchanger to the cold end temperature of the separation columns. This feed air portion which bypasses entirely the primary heat exchanger and undergoes a high ratio turboexpansion enables the production of product, especially in liquid form, with high efficiency and low unit power consumption. Further, the use of the high ratio turboexpander reduces the turbine air fraction and thereby allows higher argon recovery.

The invention will be described in detail with reference to the Drawing. Referring now to the FIGURE, feed air 60 is compressed by passage through base load air compressor 30 to a pressure generally within the range of from 70 to 110 pounds per square inch absolute (psia). Resulting feed air 61 is cleaned of high boiling impurities such as water vapor, carbon dioxide and hydrocarbons by passage through prepurifier 50. A first portion 67 of the resulting prepurified feed air 63 is passed through primary heat exchanger 1 wherein it is cooled by indirect heat exchange with return streams. The resulting cleaned and cooled feed air 70 is passed into higher pressure column 10 of the cryogenic air separation plant which also comprises lower pressure column 11.

A second portion 66 of prepurified feed air 63 is compressed to a high pressure by passage through booster compressor 31 to produce high pressure feed air portion 68 having a pressure of at least 270 psia and generally within the range of from 400 to 800 psia. In the embodiment illustrated in the FIGURE, a portion 69 of the high pressure feed air 68 is passed through primary heat exchanger 1 wherein it is at least partially condensed and serves to boil liquid oxygen product. Resulting feed air stream 72 is then passed into higher pressure column 10.

At least some of the high pressure feed air 68 from booster compressor 31, illustrated in the FIGURE as stream 64, bypasses primary heat exchanger 1 entirely and is passed as input to high ratio turboexpander 32 wherein it is turboexpanded to a low pressure generally within the range of from 18 to 30 psia. The ratio of the feed air input pressure to high ratio turboexpander 32 to the feed air output pressure from turboexpander 32, termed the turboexpansion ratio, is at least 15 and may be as high as about 70. Generally, the turboexpansion ratio will be within the range of from 25 to 40. The turboexpanded output from high ratio turboexpander 32 is then passed into the cryogenic air separation plant. In the embodiment illustrated in the FIGURE, turboexpanded feed air stream 82 is further cooled by passage through desuperheater 5 and then passed as stream 83 into lower pressure column 11 of the cryogenic air separation plant. If desired, the high pressure feed air input to the high ratio turboexpander may undergo precooling, as, for example, by an external freon based refrigeration unit, prior to being passed into the high ratio turboexpander.

Higher pressure column 10 is operating at a pressure generally within the range of from 70 to 100 psia. Within high pressure column 10 the feed air is separated by cryogenic rectification into oxygen-enriched liquid and nitrogen-enriched vapor. Oxygen-enriched liquid is withdrawn from the lower portion of higher pressure column 10 in stream 86, subcooled by passage through a portion of subcooler 6 and then passed as stream 87 into lower pressure column 11. Nitrogen-enriched vapor is withdrawn from the upper portion of higher pressure column 10 in stream 74 and passed into main condenser 20 wherein it is condensed by indirect heat exchange with boiling lower pressure column bottom liquid. Resulting nitrogen-enriched liquid 75 is divided into a first portion 88, which is returned to the upper portion of higher pressure column 10 as reflux, and into a second portion 89 which is subcooled by passage through a portion of subcooler 6 and then passed as stream 90 into the upper portion of lower pressure column 11 as reflux.

Lower pressure column 11 is operating at a pressure less than that of higher pressure column 10 and generally within the range of from 18 to 30 psia. Within lower pressure column 11 the various feeds into the column are separated by cryogenic rectification into nitrogen-rich vapor and oxygen-rich liquid. Nitrogen-rich vapor is withdrawn from the upper portion of lower pressure column 11 in stream 91, warmed by passage through subcooler 6, passed as stream 92 to primary heat exchanger 1 wherein it is further warmed, and withdrawn from the system as stream 93 which may be recovered in whole or in part as product nitrogen having a nitrogen concentration of at least 98 mole percent.

oxygen-rich liquid is withdrawn from the lower portion of lower pressure column 11 in stream 76. If desired a portion of the oxygen-rich liquid, shown in the FIGURE as stream 77, may be recovered as liquid oxygen product. The FIGURE illustrates an embodiment of the invention wherein oxygen gas product is recovered at an elevated pressure. The oxygen-rich liquid is passed to liquid pump 33 as shown by stream 78 wherein it is pumped to an elevated pressure generally within the range of from 40 to 300 psia. Resulting elevated pressure oxygen-rich liquid 79 is warmed by passage through desuperheater 5 by indirect heat exchange with cooling turboexpanded stream 82, and then passed as stream 90 into and through primary heat exchanger 1 wherein it is vaporized and from which it is recovered as elevated pressure gaseous oxygen product having an oxygen concentration of at least 95 mole percent, but typically about 99.5 mole percent.

Now with the use of this invention, process refrigeration for a cryogenic air separation plant may be provided in a more cost effective manner especially at higher power requirements associated with the production of liquid and/or elevated pressure product(s).

Although the invention has been described in detail with reference to a certain preferred embodiment, those skilled in the art will recognize that there are other embodiments of the invention within the spirit and scope of the claims.

We claim:

1. A method for carrying out cryogenic air separation comprising:

(A) passing a first portion of the feed air for a cryogenic air separation plant through a primary heat exchanger and thereafter passing the first feed air portion into the cryogenic air separation plant;

(B) compressing a second portion of the feed air for the cryogenic air separation plant to a high pressure and passing at least some of the high pressure second feed air portion as input to a high ratio turboexpander without passing through any portion of the primary heat exchanger;

(C) turboexpanding the high ratio turboexpander input through the high ratio turboexpander and passing the resulting turboexpanded output into the cryogenic air separation plant;

(D) separating the feed air within the cryogenic air separation plant by cryogenic rectification to produce at least one of product oxygen and product nitrogen; and (E) recovering at least one of product oxygen and product nitrogen from the cryogenic air separation plant.

2. The method of claim 1 wherein the cryogenic air separation plant comprises a higher pressure column and a lower pressure column and the turboexpanded output is passed into the lower pressure column.

3. The method of claim 1 wherein the turboexpanded output is cooled prior to being passed into the cryogenic air separation plant.

4. The method of claim 3 wherein the turboexpanded output is cooled by indirect heat exchange with product oxygen.

5. Apparatus for carrying out cryogenic air separation comprising:

(A) a primary heat exchanger and a cryogenic air separation plant;

(B) means for passing feed air to the primary heat exchanger and from the primary heat exchanger to the cryogenic air separation plant;

(C) a booster compressor, a high ratio turobexpander, means for passing feed air to the booster compressor, and means for passing feed air from the booster compressor to the high ratio turboexpander without passing through the primary heat exchanger;

(D) means for passing feed air from the high ratio turboexpander to the cryogenic air separation plant; and (E) means for recovering product from the cryogenic air separation plant.

6. The apparatus of claim 5 wherein the cryogenic air separation plant comprises a higher pressure column and a lower pressure column and the means for passing feed air from the high ratio turboexpander to the cryogenic air separation plant communicates with the lower pressure column.

7. The apparatus of claim 5 further comprising a desuperheater wherein the means for passing feed air from the turboexpander to the cryogenic air separation plant includes the desuperheater.

8. The apparatus of claim 7 further comprising a liquid pump, means for passing liquid from the lower portion of the lower pressure column to the liquid pump, means for passing liquid from the liquid pump to the desuperheater, and means for passing liquid from the desuperheater to the primary heat exchanger.

* * * * *